US008462064B2

(12) United States Patent
Packer et al.

(10) Patent No.: US 8,462,064 B2
(45) Date of Patent: Jun. 11, 2013

(54) MULTIBAND DISMOUNT ANTENNA

(75) Inventors: Malcolm Packer, Fairport, NY (US); Pablo Diez, Fairport, NY (US); Thomas Walter, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 363 days.

(21) Appl. No.: 12/846,207

(22) Filed: Jul. 29, 2010

(65) Prior Publication Data

US 2012/0026049 A1 Feb. 2, 2012

(51) Int. Cl.
*H01Q 9/16* (2006.01)

(52) U.S. Cl.
USPC ..... 343/747; 343/802

(58) Field of Classification Search
USPC ..... 343/745, 747, 749, 802, 846
See application file for complete search history.

(56) References Cited

U.S. PATENT DOCUMENTS

| | | | | |
|---|---|---|---|---|
| 2,311,472 | A * | 2/1943 | Rossenstein | 343/750 |
| 2,719,920 | A | 10/1955 | Ellis | |
| 4,161,710 | A | 7/1979 | Kakurai | |
| 4,170,014 | A | 10/1979 | Sully | |
| 4,335,386 | A | 6/1982 | Johns | |
| 4,509,056 | A | 4/1985 | Ploussios | |
| 4,882,591 | A | 11/1989 | Galvin et al. | |
| 5,065,164 | A * | 11/1991 | Deasy | 343/749 |
| 5,134,419 | A * | 7/1992 | Egashira | 343/722 |
| 6,163,300 | A | 12/2000 | Ishikawa et al. | |
| 6,429,821 | B1 | 8/2002 | Lewis, Jr. | |
| 7,187,335 | B2 * | 3/2007 | Vincent | 343/722 |

OTHER PUBLICATIONS

Shanney, B., "Controlled-Current-Distribution Antenna Performance: By Analysis" [internet][retrieved on Jul. 12, 2011] Retrieved from the Internet www.ccdantennas.com/.../Controlled_Current_Distribution_antenna_performance.pdf.

Mills, H., et al., "The CCD Antenna—Improved, Ready-to-Use Construction Data" [internet][retrieved on Jul. 12, 2011] Retrieved from the Internet www.presenceknown.com/ccd/docs/CCD_Improved.pdf.

* cited by examiner

*Primary Examiner* — James H Cho
(74) *Attorney, Agent, or Firm* — Fox Rothschild, LLP; Robert J. Sacoo

(57) ABSTRACT

Antennas and methods for controlling antennas for producing electromagnetic radiation in a desired direction over a wide range of wavelengths. A current distribution is controlled in one or more conductive radiating elements of an antenna to form, at every wavelength within a pattern wavelength range, an antenna radiation pattern having a peak in a direction substantially orthogonal to a length of an elongated conductive radiating element or elements. By careful control of the current distribution, the pattern wavelength range is made exceptionally broad. In the case of a dipole antenna, the pattern wavelength can range from about ⅓l to at least about 8l, where l is an approximate combined length of a pair of elongated elements forming a dipole antenna. Alternatively, in the case of a monopole antenna, the pattern wavelength range can extend from about ⅙l to at least about 4l, where l is an approximate overall length of the monopole antenna.

23 Claims, 6 Drawing Sheets

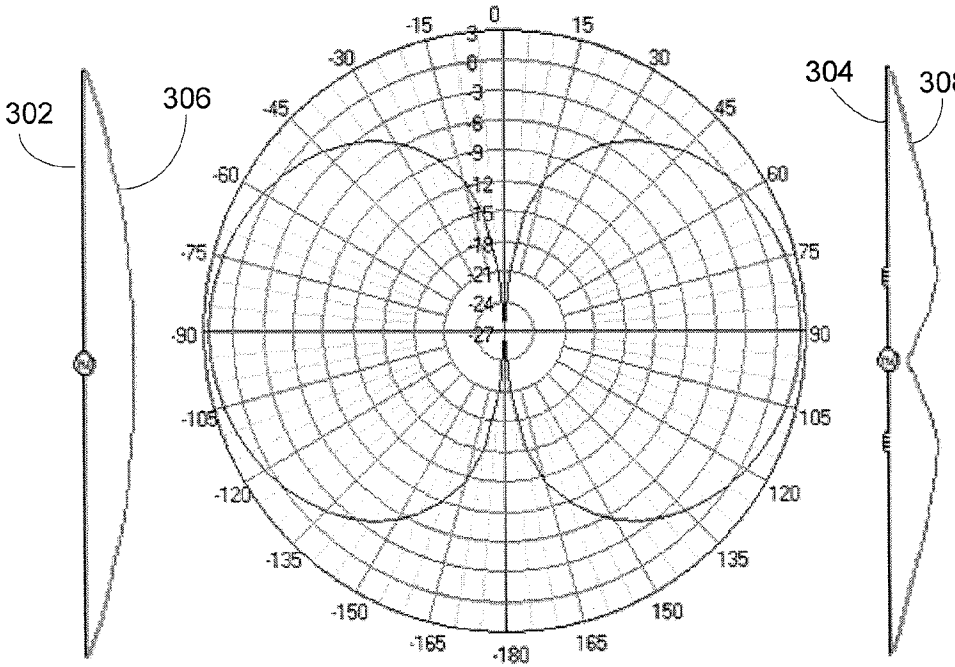
FIG. 3A
0.5 λ dipole
FIG. 3B
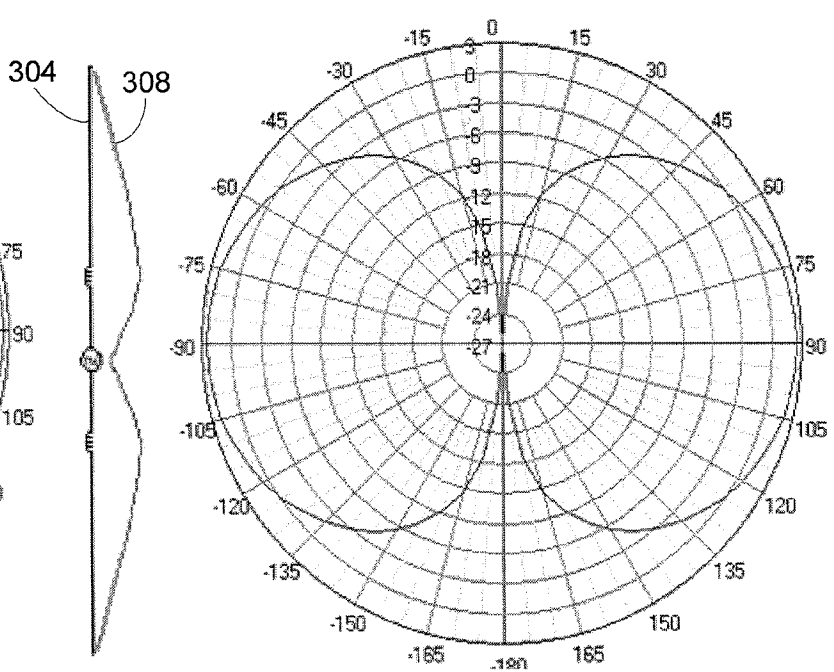
FIG. 3C
0.5 λ dipole with inductors
FIG. 3D

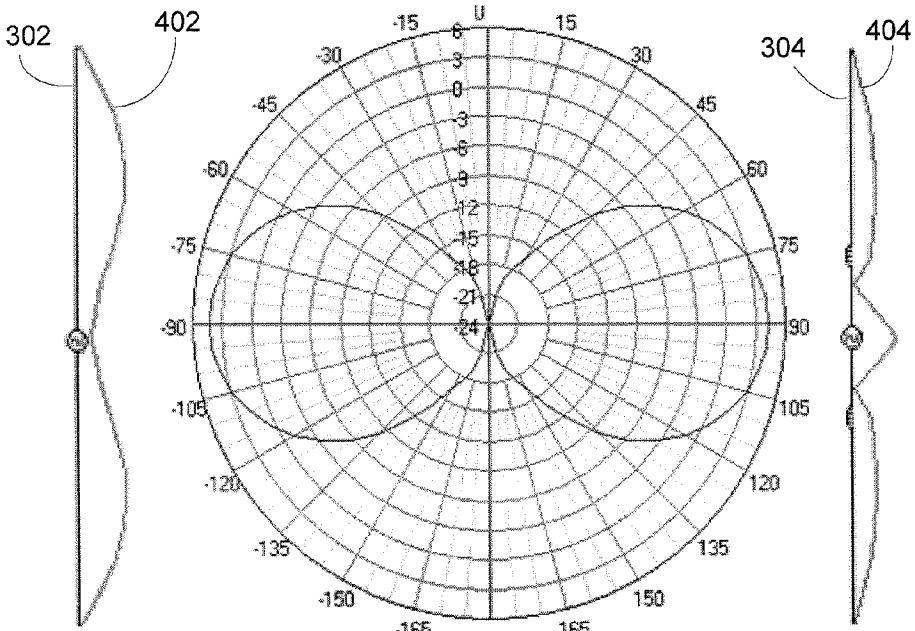
FIG. 4A
1.0 λ dipole
FIG. 4B
FIG. 4C
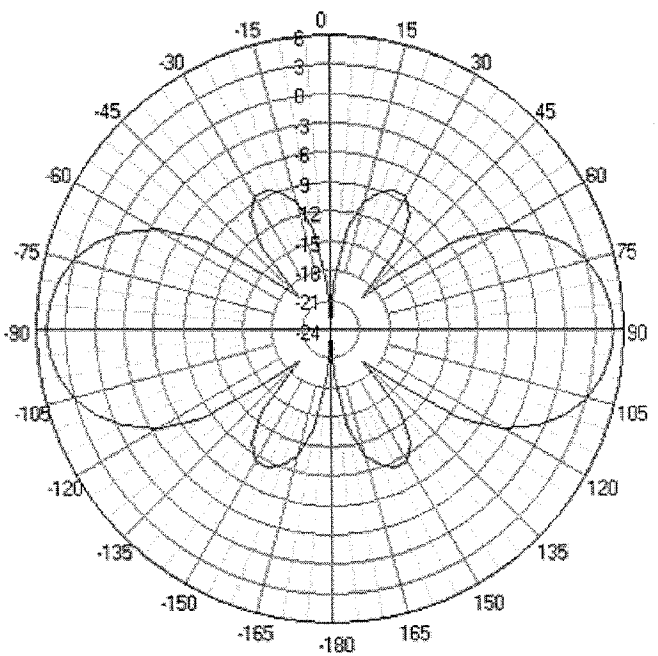
1.0 λ dipole with inductors
FIG. 4D

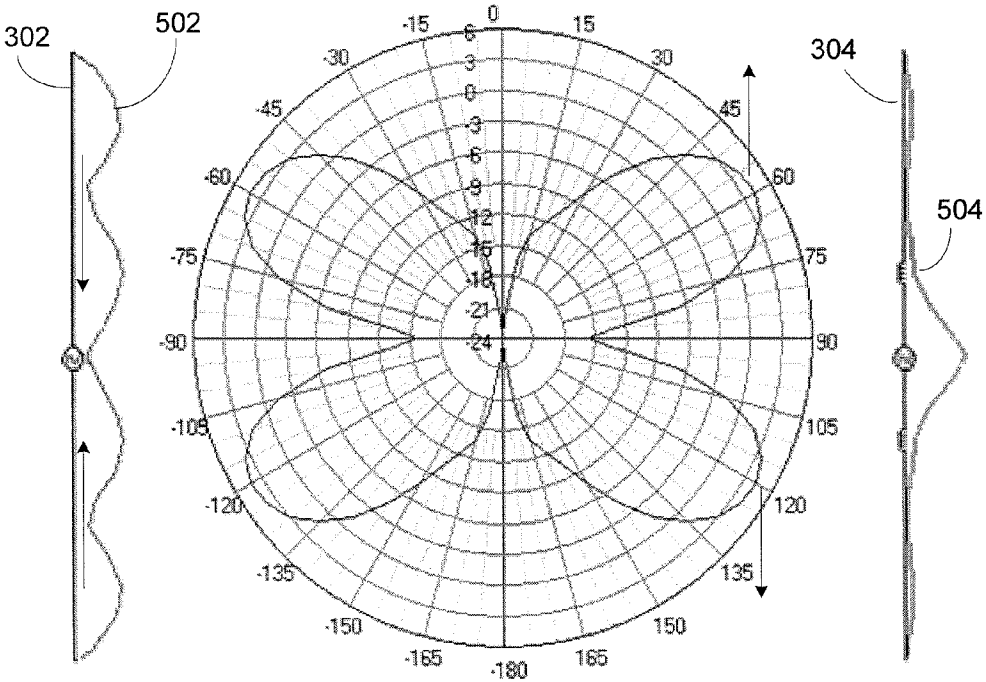
2.0 λ dipole
FIG. 5A
FIG. 5B
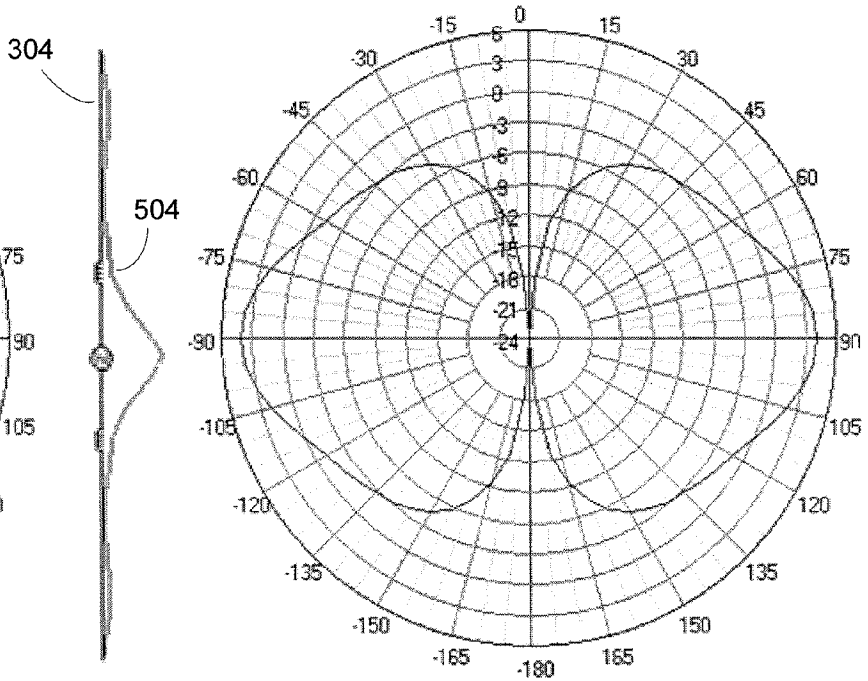
2.0 λ dipole with inductors
FIG. 5C
FIG. 5D

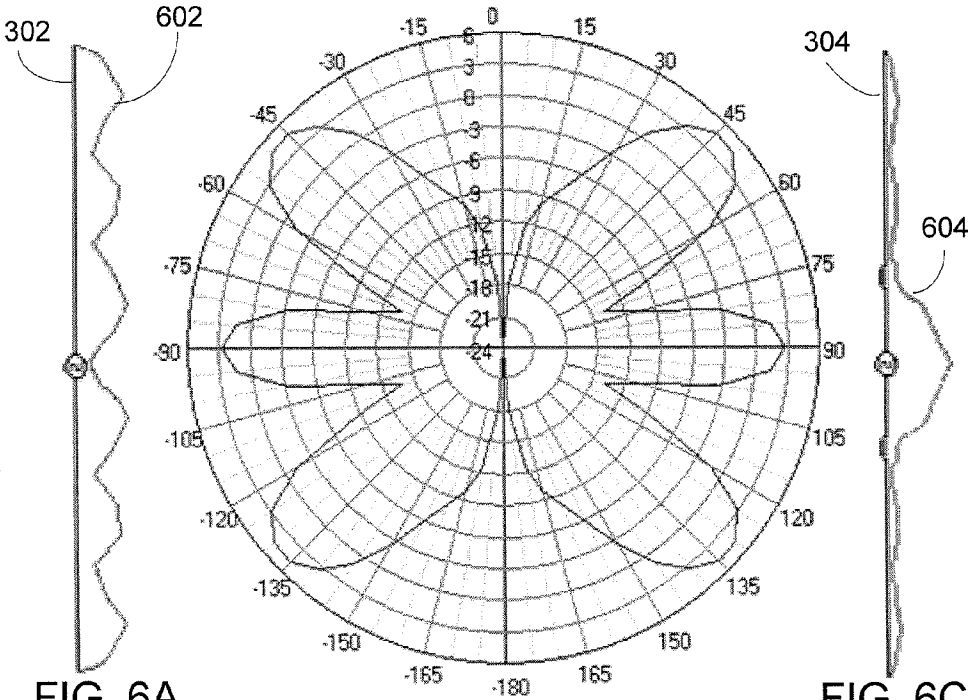
FIG. 6A
3.0 λ dipole
FIG. 6B
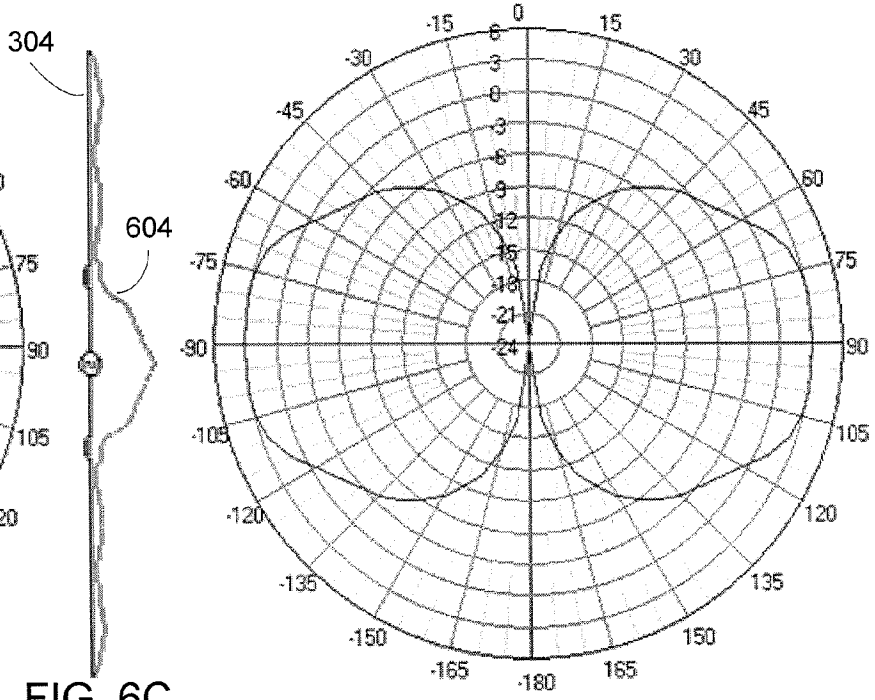
FIG. 6C
3.0 λ dipole with inductors
FIG. 6D

MULTIBAND DISMOUNT ANTENNA

BACKGROUND OF THE INVENTION

1. Statement of the Technical Field

The inventive arrangements relate to antennas, and more particularly to antennas having very wide impedance bandwidth and pattern bandwidth.

2. Description of the Related Art

For design purposes, an antenna can be thought of as having two ports. During transmission, the first port (which is commonly referred to as the antenna feed port) allows energy to flow from a transmission line into the antenna. The transmission line will have some characteristic impedance, such as 50Ω. The second port can be envisioned as allowing energy to flow from the antenna into free space. Free space has a characteristic impedance of 120/πΩ.

An antenna is sometimes loosely described in terms of its "bandwidth." Bandwidth usually refers to the range of operating frequencies over which the antenna is designed to provide some level of satisfactory performance. However, there are actually at least three different performance characteristics that define an antenna's useful operating frequency range. Specifically, antenna performance is appropriately considered with regard to input impedance, gain and radiation pattern, each of which can serve to limit the useful bandwidth or operating frequency range of the antenna. For example, it is usually desirable for antenna input impedance to be maintained within a desired range so that the input VSWR for the antenna is less than about 3:1. The useful bandwidth of an antenna can be limited when the input impedance is outside of such desired range. Likewise, an antenna may not have sufficient gain outside a certain operating frequency range and this factor can limit the useable bandwidth of the antenna. Finally, an antenna can exhibit an undesirable radiation pattern at certain frequencies, and this too can limit the useful bandwidth of the antenna.

Inductors have long been used within antennas to make the antenna appear electrically longer, or stated another way, to make a physically short antenna (<0.5λ) appear electrically resonant. The ideal inductor placement and size is a function of practicality versus functionality. The most efficient implementation of such antennas is an infinitely large inductor at the element end opposed from the feed. This results in a uniform current distribution over the entire length of the antenna element. Conversely, the most practical implementation is generally a small inductor placed near the feed system. This results in a uniform current distribution from the feed to the inductor and then triangular distribution to the element end. Between these limiting cases, the inductor size grows as the inductor is placed further away from the feed point. A trade-off analysis can be performed to determine the most advantageous inductor size and placement to make a short antenna appear electrically resonant in a particular application.

SUMMARY OF THE INVENTION

The invention concerns antennas and methods for controlling antennas for producing electromagnetic radiation in a desired direction over a wide range of wavelengths. A current distribution is controlled in one or more conductive radiating elements of an antenna to form, at every wavelength or fractional wavelength within a pattern wavelength range, an antenna radiation pattern having a peak in a direction substantially orthogonal to a length of an elongated conductive radiating element or elements. The pattern wavelength range is exceptionally broad. In the case of a dipole antenna variant, the pattern wavelength range from about ⅓l to at least about 8l, where l is an approximate combined length of a pair of elongated elements forming a dipole antenna. Alternatively, in the case of a monopole antenna variant, the pattern wavelength range can extend from about ⅙l to at least about 4l, where l is an approximate overall length of the monopole antenna.

According to one aspect, the invention includes a dipole or monopole antenna configured for producing electromagnetic radiation in a desired direction over a wide range of wavelengths as described above. The antenna radiation pattern peak has a direction substantially orthogonal to a length of an elongated conductive radiating element of the antenna. This radiation pattern peak is provided in the orthogonal direction over all wavelengths within a pattern wavelength range as defined above.

According to another aspect, the invention includes a radio system. The radio system includes a dipole or monopole antenna excited by a transmitter and configured for producing electromagnetic radiation in a desired direction over a wide range of wavelengths as described above. The antenna is configured for producing an antenna radiation pattern peak in a direction substantially orthogonal to a length of an elongated conductive radiating element of the antenna over all wavelengths within a pattern wavelength range as defined above.

BRIEF DESCRIPTION OF THE DRAWINGS

Embodiments will be described with reference to the following drawing figures, in which like numerals represent like items throughout the figures, and in which:

FIG. 3A shows a current distribution for a conventional dipole antenna having a length equal to 0.5%.

FIG. 3B shows a computer generated plot of an antenna radiation pattern which would result for the antenna in FIG. 3A, where the antenna length is aligned along the 0/−180 axis in FIG. 3B.

FIG. 3C shows a current distribution for a dipole antenna designed in accordance with the inventive arrangements having a length equal to 0.5λ.

FIG. 3D shows a computer generated plot of an antenna radiation pattern which would result for the antenna in FIG. 3C, where the antenna length is aligned along the 0/−180 axis in FIG. 3D.

FIG. 4A shows a current distribution for a conventional dipole antenna having a length equal to 1.0λ.

FIG. 4B shows a computer generated plot of an antenna radiation pattern which would result for the antenna in FIG. 4A, where the antenna length is aligned along the 0/−180 axis in FIG. 4B.

FIG. 4C shows a current distribution for a dipole antenna designed in accordance with the inventive arrangements having a length equal to 1.0λ.

FIG. 4D shows a computer generated plot of an antenna radiation pattern which would result for the antenna in FIG. 4C, where the antenna length is aligned along the 0/−180 axis in FIG. 5D.

FIG. 5A shows a current distribution for a conventional dipole antenna having a length equal to 2.0λ.

FIG. 5B shows a computer generated plot of an antenna radiation pattern which would result for the antenna in FIG. 5A, where the antenna length is aligned along the 0/−180 axis in FIG. 5B.

FIG. 5C shows a current distribution for a dipole antenna designed in accordance with the inventive arrangements having a length equal to 2.0λ.

FIG. 5D shows a computer generated plot of an antenna radiation pattern which would result for the antenna in FIG. 5C, where the antenna length is aligned along the 0/−180 axis in FIG. 5D.

FIG. 6A shows a current distribution for a conventional dipole antenna having a length equal to 3.0λ

FIG. 6B shows a computer generated plot of an antenna radiation pattern which would result for the antenna in FIG. 6A, where the antenna length is aligned along the 0/−180 axis in FIG. 6B.

FIG. 6C shows a current distribution for a dipole antenna designed in accordance with the inventive arrangements having a length equal to 3.0λ.

FIG. 6D shows a computer generated plot of an antenna radiation pattern which would result for the antenna in FIG. 6C, where the antenna length is aligned along the 0/−180 axis in FIG. 6D.

DETAILED DESCRIPTION

Figure 1A:
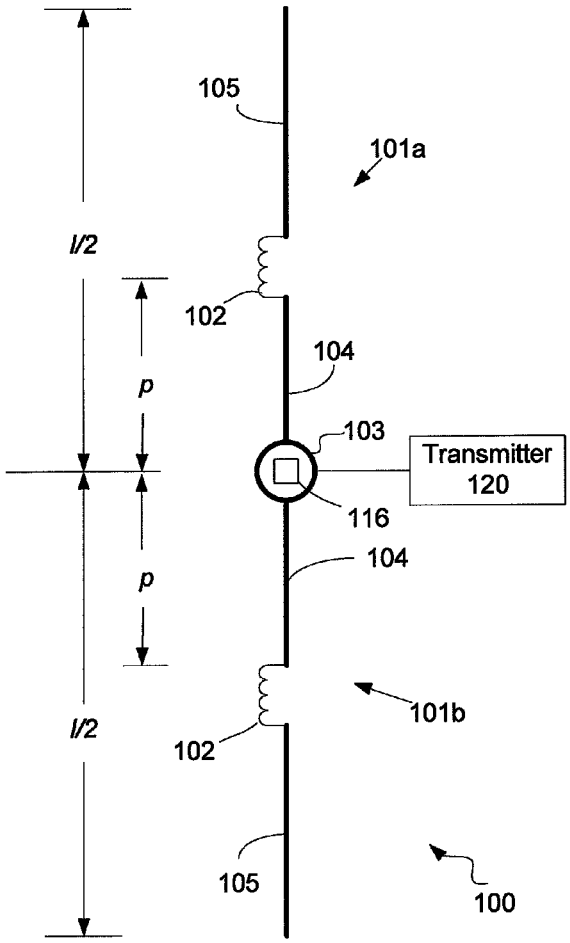
FIG. 1A is a drawing that is useful for understanding the structure of a dipole antenna in accordance with the inventive arrangements.

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

Antenna performance is evaluated with respect to input impedance, gain and radiation pattern, each of which can serve to limit the useful bandwidth (or useful operating frequency range) of the antenna. Typically, the narrowest bandwidth (when comparing bandwidth limits associated with input impedance, gain and radiation pattern) is the input impedance bandwidth. This bandwidth limit is due to the impedance mismatch as between the transmission line which feeds the antenna and the antenna's input impedance. A matching network is commonly used to increase the input impedance bandwidth which allows energy to get into the antenna. Having resolved that issue with an impedance matching network, the next issues an antenna designer must address are the gain and/or pattern wavelength range.

As used herein, the phrase "pattern wavelength range" shall refer to the range of input signal wavelengths over which the antenna will provide an antenna radiation pattern that meets certain predefined performance criteria. For example, in many situations involving dipole and monopole antennas, it is desirable to provide a substantial amount of gain in a direction orthogonal to the length of the antenna. As input signal wavelength decreases (frequency increase), the direction of maximum gain will deviate from this orthogonal direction and a null will begin to form in the orthogonal direction. The antenna will no longer satisfy performance criteria when the direction of maximum antenna gain deviates from the orthogonal by some predetermined amount determined by a designer. The radiation pattern and gain values are controlled by the physical conductor geometry, and more specifically the current distribution on the conductor.

Wideband antennas present special design challenges with regard to pattern wavelength range. In order to more fully understand the problem of pattern wavelength range, it is useful to consider how the pattern of a fixed length dipole antenna will change with variations in frequency. An antenna of fixed physical size or length will appear electrically larger as the frequency is increased. In other words, since a wavelength decreases in size as the frequency increases, a fixed physical length antenna will naturally increase in electrical length as frequency is increased. This occurs because electrical length is measured in terms of wavelengths.

As noted above, the pattern wavelength range is generally defined by the range of wavelengths or frequencies over which the antenna's radiation pattern main beam or lobe extends in a desired direction. The radiation pattern of a dipole begins to distort when the antenna length goes beyond 1.0λ, where λ is the symbol for wavelength. As the length approaches 2λ, a compete cancellation of energy occurs in the direction orthogonal to the length of the antenna. For example, a vertical dipole having a length of 2λ will have a null it its antenna beam in the direction of the horizon. This is highly undesirable for many antenna applications.

Note that the foregoing problem can also be restated by defining the input wavelength in terms of the antenna length. Thus, in the foregoing example for an antenna of length "l" it could be said that the radiation pattern of a dipole begins to distort in undesirable ways when the input signal wavelength λ is less than 1.0l. As the input signal wavelength approaches 0.5l, a compete cancellation of energy is normally expected in the direction orthogonal to the length of the antenna. In the case of a dipole antenna, such energy cancellation will occur for all antenna length $l=2n\lambda$, where n is an integer.

In order to understand what causes the above-referenced null in the dipole radiation pattern, it is useful to consider the effect of current distribution along the length of a dipole. When a thin linear dipole's length l is a half wavelength (0.5λ dipole) it will be self-resonant and has a sinusoidal current distribution. This sinusoidal distribution is illustrated by the current distribution shown in FIG. 3A. Note that the current distribution shown is essentially half of a sine wave Stated differently, it could be said that this situation occurs when $\lambda=2.0l$. Under these circumstances, the surface currents in a dipole antenna are all moving in the same longitudinal direction and the energy radiated from the dipole elements adds in-phase. This creates a radiation pattern beam peak orthogonal to the dipole and azimuthally symmetric. This radiation pattern can be observed in FIG. 3B.

Holding the physical length constant while increasing the frequency by a factor of two results in the electrical length $l=1.0\lambda$ or $\lambda=1.0l$. Under these circumstances, the surface current will still be in the same direction and the radiation pattern beam peak is still orthogonal to the length of the antenna. This situation is illustrated in FIGS. 4A and 4B respectively.

However, once the electrical length exceeds 1.0λ (that is, λ<l), a portion of the surface current reverses direction to create two opposing surface currents as shown by the arrows in FIG. 5A. In the far field, the energy radiated from the two opposing surface currents cause new radiation pattern lobes to form. As wavelength increases, the single radiation peak separates into two separate peaks that move in both directions away from the orthogonal as illustrated in FIG. 5B. This movement results in a null forming in the direction orthogonal to the length of the antenna. Theoretically, total radiation pattern cancellation in the orthogonal direction occurs when the dipole is 2.0λ long, since equal surface currents exist in opposing directions. This phenomena can be observed in FIGS. 5A and 5B, which show the current distribution and radiation pattern respectively for a dipole antenna that is 2.0λ long. It can be observed in FIG. 5B that when the radiation pattern splits or modes in this way, it puts a null in the direction orthogonal to the length of the antenna. Practically speaking, this phenomena creates an upper frequency limit on the useful operating bandwidth of the antenna. Accordingly, this effect will necessarily limit the useful antenna radiation bandwidth of an antenna.

According to one aspect of the present invention, inductors are used to modify the current distribution in a dipole antenna to overcome the aforementioned undesirable antenna radiation pattern effects which occur when the antenna has an electrical length of approximately even multiples of λ. Referring now to FIG. 1A, a dipole antenna 100 of length l generally includes two elongated conductive radiating elements 101*a*, 101*b* (hereinafter radiating elements) of approximately equal length, each extending in opposing directions from a feed point 103 which is located at approximately a center of the antenna. An inductor 102 provided at a selected location in each radiating element divides each radiating element 101*a*, 101*b* into an inner sub-element 104, and an outer sub-element 105, for a total of four sub-elements. Thereafter, each of the sub-elements comprising the dipole antenna has its own interrelated current distribution which are related by symmetry, and which is controlled by the value of inductor 102 and the electrical length of each sub-element.

In the present invention, the value of inductor 102 in each radiating element is selected to have limited effect when the overall length l of the dipole 100 is less than 0.5λ, where λ is the wavelength of an input signal. However, the inductor values are selected so that, as the wavelength decreases in length (i.e., frequency increases), the inductors 102 control the distribution and magnitude of the electric current in the inner and outer sub-element forming each radiating element of the dipole. When the length l of the dipole is 2.0λ (typically the worst electrical length with equal and opposite currents) the current distribution in each sub-element is controlled so that the radiation pattern from each sub-element, when added with the radiation pattern of each other sub-element, provides a sum radiation pattern that has peak in a direction that is orthogonal to the axis or length of the antenna. In the case of a vertically oriented dipole, this ensures that a beam peak is maintained in a direction toward the horizon. Note that the word "peak" as used herein refers to portions or directions of an antenna radiation pattern where antenna gain is maximized or is substantially at a maximum. For example, in some embodiments the peak can refer to portions of the beam which are within about 3 dB of maximum gain. In other embodiments, the peak can also include portions of the beam which are within about 6 dB of maximum gain.

According to one aspect of the invention, numerical modeling with optimization is used to select the ideal value of inductor 102 and the ideal length of sub-elements 104, 105 to provide an antenna radiation pattern in which peak gain is directed orthogonal to the dipole length over a wide range of input frequencies. Modeling has shown that for a range of input frequencies over which the dipole 100 has a corresponding electrical length ranging from 0.25λ to 44.0λ, it is possible to limit gain fluctuation orthogonal to the dipole to less than 6 dB. In other embodiments, it has been show that it is possible to limit gain fluctuation orthogonal to the dipole to less than 3 dB. This is a substantial improvement over convention dipole antenna designs such as the one illustrated in FIG. 5B, where a deep null can be observed in the orthogonal direction (i.e., +/−90° in FIG. 5B).

Figure 1B:
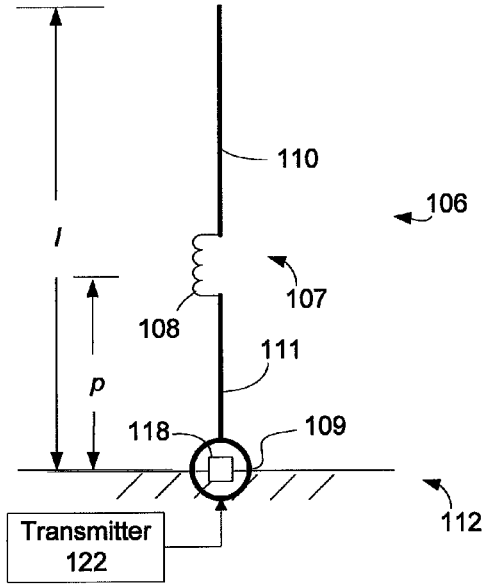
FIG. 1B is a drawing that is useful for understanding the structure of a monopole antenna in accordance with the inventive arrangements.

A similar approach as described herein with respect to the dipole antenna in FIG. 1A can also be used with respect to a monopole antenna. There is shown in FIG. 1B a monopole antenna 106 excited against a counterpoise 112. The counterpoise can be a conductive metal ground plane, radial system, physical ground or radio chassis. Such counterpoise devices are well known in the art. The monopole antenna has a conductive radiating element 107 that is comprised of inner sub-element 111 and outer sub-element 110. The sub-elements are conductively connected to each other through inductor 108. The antenna is fed with a radio frequency signal at a feed point 109.

Numerical modeling with optimization is used to select the ideal value of inductor 108 and the ideal length of sub-elements 111, 110 to provide an antenna radiation pattern in which maximum gain is provided in a direction substantially orthogonal to the length of monopole antenna 106 over an exceptionally wide range of input frequencies. Those skilled in the art will appreciate that with monopole antennas, it is common to have a null in a direction exactly orthogonal to the radiating element due to the effects of limited ground plane size. This is true for monopole antennas even when they are operating within a relatively narrow range of frequencies where l<λ. In contrast, the inventive arrangements can maintain a peak gain in a direction that is a relatively small angle relative to the orthogonal over a much wider range of frequencies as discussed below.

In the present invention, the value of inductor 108 in each radiating element 111, 110 is selected to have limited effect when the overall length l of the monopole 106 is less than 0.25λ, where λ is the wavelength of an input signal. However, the inductor values are selected so that, as the wavelength decreases in length (i.e., frequency increases), the inductor 108 controls the distribution and magnitude of the electric current in the inner and outer sub-element 111, 110. When the length l of the monopole is 1.0λ (typically the worst electrical length for a monopole) the current distribution in each sub-element is controlled so that the radiation pattern from each sub-element 111, 110, when added with the radiation pattern of the other sub-element, provides a sum radiation pattern that has peak in a direction that is substantially orthogonal to the axis or length of the monopole antenna 106. In the case of a vertically oriented monopole, this ensures that a beam peak is maintained in a direction substantially toward the horizon.

A suitable matching network 116 can be provided at the feed point 103 of the antenna 100. Similarly, a suitable matching network 118 can be provided at the feed point 109 of antenna 106. The matching network can be integrated within the feed point 103, 109 or can be provided externally. As is well known in the art, a matching network is used to ensure that the input impedance of the antennas 100 and 106 remains within a predetermined range of values throughout a range of frequencies over which the antenna is designed to operate. For example, it is often desirable for an input impedance of an antenna to be maintained within predetermined limits so that antenna input VSWR does not exceed a predetermined value (such as 3:1) over the entire range of frequencies over which the antenna is designed to operate. Still, those skilled in the art will appreciate that the invention is not limited in this regard.

Impedance matching networks are well known in the art and therefore shall not be discussed here in detail. However, it is sufficient to note that the impedance matching network 116, 118 should be selected to provide an acceptable impedance match to a transmitter (not shown) over a desired operating frequency range of the antenna.

According to some embodiments, the antenna 100 can be excited at feed point 103 by a transmitter 120 with a radio frequency signal having some wavelength within a pattern wavelength range. Likewise, antenna 106 can be excited at feed point 109 by transmitter 122 with a radio frequency signal within some pattern wavelength range.

Figure 2:
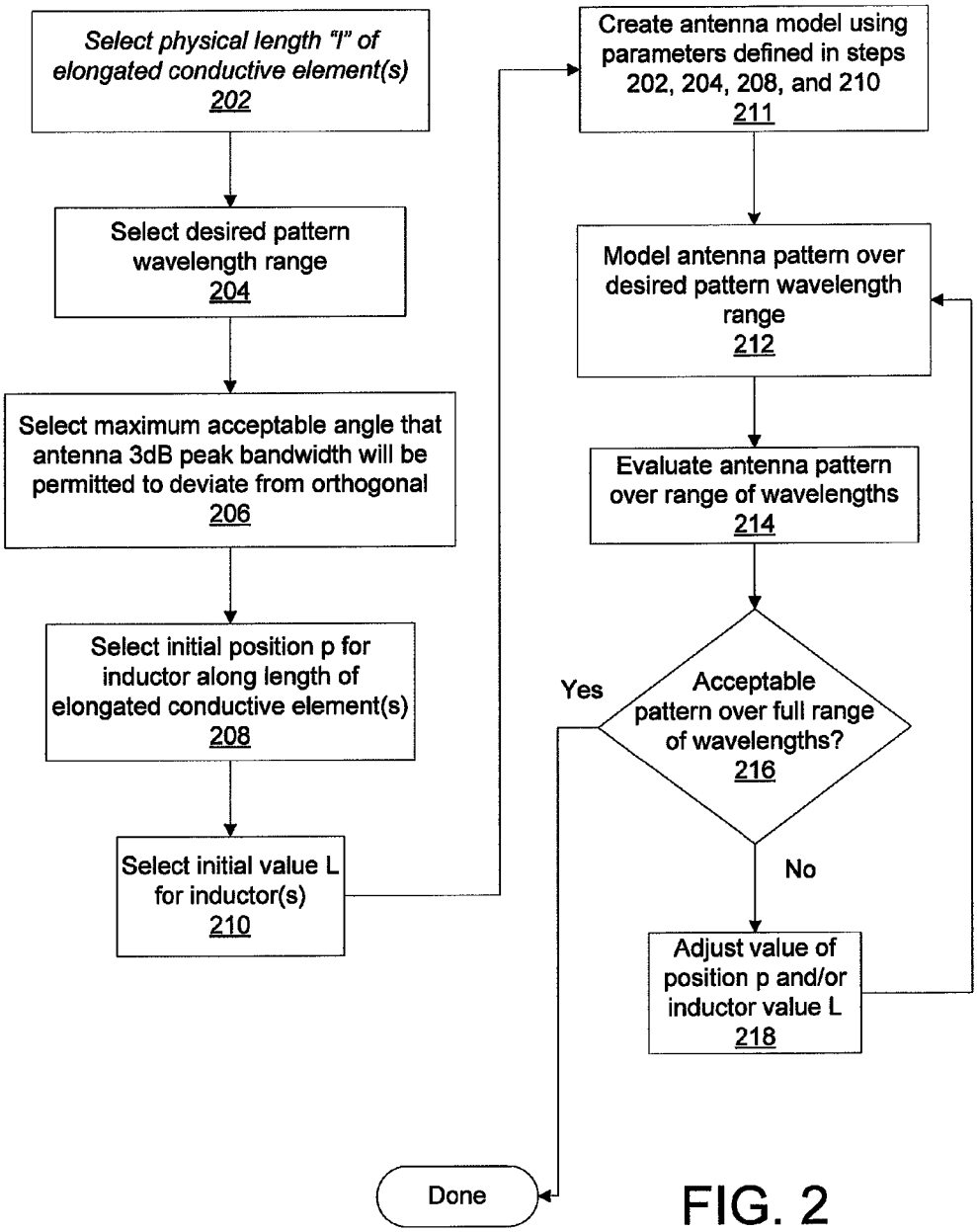
FIG. 2 is a flowchart that is useful for understanding a method for producing with a antenna electromagnetic radiation in a desired direction over a wide range of wavelengths.

Referring now to FIG. 2, a flow chart is provided which describes a method for producing with an antenna electromagnetic radiation in a desired direction for input signals having a wide range of input signal wavelengths. More particularly, a method is presented for controlling an antenna so as to produce an antenna radiation pattern having a peak gain throughout its operating wavelength range that is oriented in a direction substantially orthogonal to the antenna axis. In some embodiments, the antenna radiation pattern can be controlled to ensure that the radiation pattern in the orthogonal direction varies less than 6 dB over the radiation bandwidth of the antenna. In other embodiments, the antenna radiation pattern can be controlled to ensure that the radiation pattern in the orthogonal direction varies less than 3 dB over the radiation bandwidth of the antenna.

For purposes of clarity, the inventive arrangements in FIG. 2 shall be described with respect to the dipole antenna 100 as shown in FIG. 1A. However, one skilled in the art will appreciate that the methods described herein can also be used for the monopole element in FIG. 1B.

The method begins in step 202 with the selection of a desired physical length l of the antenna 100. The physical length can be selected by a designer to satisfy consumer or mission requirements. In step 204, the pattern wavelength range is selected to define the range of input signal wavelengths over which the antenna will provide an antenna radiation pattern that meets certain predefined performance criteria. The pattern wavelength range can be defined in accordance with a maximum wavelength (lower frequency limit) and a minimum wavelength (upper frequency limit).

In step 206, a designer selects as a design goal the maximum acceptable angular deviation that the peak of the antenna radiation pattern will be permitted to deviate from a direction orthogonal to the length of the antenna. For example, the this value can be specified as a maximum acceptable angle that the antenna radiation pattern 3 dB peak bandwidth will be permitted to deviate with respect to an orthogonal direction. Still, the invention is not limited in this regard and the maximum acceptable deviation can be specified in any convenient manner in accordance with the particular numerical modeling program.

In step 208 a designer can choose an initial position p for an inductor along a length of conductive elements. The position p can be selected in any manner compatible with the operation of the numerical modeling program. For example, p can be defined as a distance from the feed point 103, a location defined by a percentage of the overall length of radiating element 101, or by defining lengths of elements 104, 105. Applicants have found that a suitable starting point for the value of p is about 36% of the length of radiating element 101.

In step 210 a value L is chosen for inductor 102. Those skilled in the art will appreciate that the value of the inductor must be chosen so that it has a practical geometry and a self-resonance well beyond the highest frequency at which the antenna is intended to operate. Self-resonance occurs at a frequency determined by the inductor value and the parasitic capacitance in the inductor. It is desirable to avoid inductors having a self-resonance within the intended operating frequency range of the antenna because the inductor in such circumstances will tend to consume all of the energy input to the antenna. In such cases, the absorbed energy will typically cause a rapid temperature rise in the inductor and a substantial reduction in radiated energy. In general, the initial value of the inductor must be chosen to be sufficiently large in value so as to have the desired effect as described herein, but should not be chosen so large that he inductor will enter into self resonance before the upper frequency limit is met.

In step 211, each of the values selected in steps 202, 204, 208 and 210 are provided as an input parameter to a computer based numerical modeling program to create a model of the antenna. A computer based numerical modeling program for the present invention is preferably capable of modeling the electromagnetic fields generated when radio frequency energy over a selected range of wavelengths is applied to an antenna having a physical structure as previously described with respect to FIG. 1. Various computer based numerical modeling programs are available for performing such tasks. For example, the Numerical Electromagnetics Code (NEC) can be used for this purpose. Various versions of NEC are commercially available for modeling of wire and surface antennas. Another acceptable numerical modeling program for this purpose is a finite element method solver for electromagnetic structures. This program is commercially available from Ansoft Corporation of Pittsburgh, Pa. under the name High Frequency Structure Solver (HFSS).

Referring once again to FIG. 2, the computer based numerical modeling program in step 211 is used in step 212 to model an antenna radiation pattern for an antenna 100. More particularly, the input wavelength to the antenna model is varied incrementally and the resulting antenna radiation pattern determined at each incremental wavelength over a range of wavelengths corresponding to the pattern wavelength range. In steps 214 and 216, the resulting antenna radiation pattern at each incremental wavelength is evaluated and a determination is made as to whether acceptable antenna radiation patterns have been achieved over the full range of wavelengths. More particularly, in step 216 a determination can be made as to whether the antenna radiation pattern satisfies (or substantially satisfies) the parameters in step 206 at every wavelength in the pattern wavelength range which has been modeled.

The evaluation in step 214 can be performed by any suitable means. For example, such evaluation can be performed using computer based statistical analysis to determine whether the antenna satisfies the requirements established in step 206. In some embodiments of the invention, the results of the computer based numerical modeling program can be communicated to a statistical analysis application program for purposes of performing the evaluation in step 214. The statistical analysis application program can be executed on the same computer as the numerical modeling program or a different computer. Alternatively, the numerical modeling program can directly perform such statistical analysis to evaluate the modeling results in step 214.

If, in step 216, a determination is made that the modeled antenna with the current set of parameters satisfies the requirements specified in step 206, then the process can terminate. However, if it is determined in step 216 that a satisfactory set of antenna radiation patterns has not been obtained, then a value defining position p and/or an inductor value L can be incrementally modified in step 218. The process then returns to steps 212 where the modeling, evaluation decision, and adjustments steps are subsequently repeated until acceptable antenna radiation patterns are achieved.

From the foregoing it will be understood that the design process involves determining a length of each sub-element and an inductance value of the first and second inductor based on numerical antenna modeling. In such numerical modeling, the length of each sub-element and the inductance value are iteratively varied to determine optimum values for maintaining the antenna radiation pattern peak in the orthogonal direction throughout the pattern wavelength range. Although not explicitly shown in FIG. 2, the length of each sub-element and the inductance value can also be iteratively varied to determine optimum values for minimizing gain variation in a direction orthogonal to the axis.

The invention has been described in terms of an antenna having a dipole structure as shown in FIG. 1A. However, those skilled in the art will appreciate that substantially the same approach can also be used for the monopole arrangement shown in FIG. 1B. In such case, the antenna in FIG. 1B would be modeled in step 211 and the maximum acceptable angle in step 206 would be selected.

Example 1

Using the techniques described herein, two practical designs were developed. In one design a monopole antenna of length 45 inches was developed. Absent the techniques provided herein, the monopole antenna had a useful pattern wavelength range corresponding to frequencies between 30 MHz and 108 MHz. By controlling the current distribution using the techniques described herein, the pattern wavelength range was extended to correspond to a frequency range between 30 MHz and 512 MHz. Significantly, this much broader pattern wavelength range is provided while maintaining a 3 dB peak bandwidth in a direction substantially orthogonal to the length or axis of the antenna throughout the entire pattern wavelength range. More particularly, with the monopole antenna in a vertical orientation, the 3 dB peak bandwidth was maintained within 10 degrees of the horizon throughout the entire pattern wavelength range. In this design, a 250 nH inductor was positioned at a location p that was approximately 13 inches from the feed. In the absence of controlling the current distribution using the techniques described herein, a deep null in the antenna radiation pattern for this antenna would be present in the orthogonal direction at approximately 270 MHz. This null is eliminated by using the techniques described herein.

Example 2

In a second design, a monopole antenna of length 13 inches was developed. Absent the techniques provided herein, the monopole antenna had a useful pattern wavelength range corresponding to frequencies between 30 MHz and 512 MHz. By controlling the current distribution using the techniques described herein, the pattern wavelength range was extended to correspond to a frequency range between 30 MHz and 870 MHz. Significantly, this much broader pattern wavelength range is provided while maintaining a 3 dB peak bandwidth in a direction substantially orthogonal to the length or axis of the antenna throughout the pattern wavelength range of the antenna. More particularly, with the monopole antenna in a vertical orientation, the 3 dB peak bandwidth was maintained within 10 degrees of the horizon throughout the entire pattern wavelength range. In this design, a 47 nH inductor was positioned at a location p that was approximately 9 inches from the feed. In the absence of controlling the current distribution using the techniques described herein, a deep null in the antenna radiation pattern for this antenna would be present in the orthogonal direction at 760 MHz. This null is eliminated by using the techniques described herein.

Referring now to FIGS. 3-6 there are shown a series of comparison plots which illustrate the dramatic improvement in antenna performance that is achieved by controlling antenna current distribution in accordance with the inventive arrangements. The plots compare current distribution and antenna radiation pattern for a conventional dipole antenna and for a dipole antenna modified using the techniques described herein. For purposes of this computer simulation, the value location of the inductor was such that the value of p in FIG. 1 was approximately 30% of l/2. Stated differently, the distance from feed point 103 to the inductor 102 was modeled as p=0.3(l/2). The value of the inductor 102 in this simulation was 250 nH. Referring to FIGS. 3A and 3C, there is shown a conventional dipole antenna 302 with a current distribution 306, and a dipole 304 modified with inductors in accordance with the inventive arrangements (modified dipole), where the relationship between dipole length and wavelength in each case is such that the antenna length l is 0.5λ. Stated differently, it could be said that λ=2l.

Note that in FIG. 3B, the antenna 302 is oriented in alignment with the line defined by the 0°/−180° points on the plot. In FIG. 3D, the antenna 304 is similarly oriented in alignment with the line defined by the 0°/−180° points on the plot. As would normally be expected where l is 0.5λ, the antenna radiation pattern in FIG. 3B has peak gain in the +90° and −90° directions, which are orthogonal to the length of the antenna 302. A similar antenna radiation pattern result can be observed in FIG. 3D, showing that the inclusion of the inductors 102 in the modified dipole has not adversely affected the gain pattern. Note that the antenna current distribution 308 in FIG. 3C is slightly modified relative to current distribution 306 in FIG. 3A.

Referring now to FIGS. 4A and 4C, there is shown the same conventional dipole antenna 302 and dipole 304, where the relationship between dipole length and wavelength is now such that the antenna length l is 1.0λ. Stated differently, it could be said that λ=1.0l. In FIGS. 4B and 4D, the antennas 302, 304 are oriented in alignment with the line defined by the 0°/−180° points on the respective plots.

As would normally be expected where l is 1.0λ, the antenna radiation pattern in FIG. 4B has peak gain in the +90° and −90° directions, which are orthogonal to the length of the antenna 302. A similar antenna radiation pattern result can be observed in FIG. 4D, showing that the inclusion of the inductors 102 has modified the resulting antenna radiation pattern somewhat, but peak gain is still directed in the desired +90° and −90° directions. It can also be observed that the current distribution pattern 404 in FIG. 4C has been changed relative the current distribution pattern 402 in FIG. 4A.

Referring now to FIGS. 5A and 5C, there is shown the same conventional dipole antenna 302 and dipole 304, where the relationship between dipole length and wavelength is now such that the antenna length l is 2.0λ. Stated differently, it could be said that λ=0.5l. In FIGS. 5B and 5D, the antennas 302, 304 are oriented in alignment with the line defined by the 0°/−180° points on the respective plots.

As would normally be expected where l is 2.0λ, the antenna radiation pattern in FIG. 5B has degraded substantially. There is a deep null in the +90° and −90° directions, which are orthogonal to the length of the antenna 302. However, it can be observed in FIG. 5D, that for the modified dipole 304, the resulting antenna radiation pattern still shows peak gain directed in the desired +90° and −90° directions. It can also be observed that the current distribution pattern 504 in FIG. 5C has been changed relative to the current distribution pattern 502 in FIG. 5A.

Referring now to FIGS. 6A and 6C, there is shown the same conventional dipole antenna 302 and dipole 304, where the relationship between dipole length and wavelength is now such that the antenna length l is 3.0%. Stated differently, it could be said that 2=0.33l. In FIGS. 6B and 6D, the antennas 302, 304 are oriented in alignment with the line defined by the 0°/−180° points on the respective plots.

As would normally be expected where l is 3.0λ, the antenna radiation pattern in FIG. 6B has degraded substantially. There is a peak in the +90° and −90° directions, which are orthogonal to the length of the antenna 302. However, the peak is very narrow. Moreover, it can be observed that the antenna radiation pattern has larger, broader peaks at angles +/−45° and +/−135°. Accordingly, a very significant portion of the radiated energy is directed at angles which are not orthogonal to the length of the antenna. In contrast, it can be observed in FIG. 6D, that for the modified dipole 304, the resulting antenna radiation pattern still shows a broad peak directed in the desired +90° and −90° directions. It can also be observed that the current distribution pattern 604 in FIG. 6C has been changed relative to the current distribution pattern 602 in FIG. 6A.

Based on the plots in FIGS. 3-6, those skilled in the art will appreciate that a substantial improvement in antenna radiation pattern is obtained where current distribution is controlled using the techniques described herein. With the inventive arrangements, the deep nulls and undesirable pattern effects normally observed at certain wavelengths have been eliminated and consistently broad orthogonal antenna radiation patterns are provided instead.

From the foregoing, it will be appreciated by those skilled in the art that a method has been provided for producing with a dipole antenna electromagnetic radiation in a desired direction over a wide range of wavelengths. The method consists of exciting with a radio frequency signal first and second elongated conductive radiating elements of a dipole antenna having a combined overall length l to produce an oscillating time varying electric current within the first and second elongated conductive radiating elements.

The method further includes selectively varying the radio frequency signal to have any wavelength λ within a pattern wavelength range of the antenna extending from at least about 0.5l to at least about 2.0l. In other embodiments, the method includes selectively varying the radio frequency to have any wavelength within a pattern wavelength range of the antenna extending from about ⅓l to about 4l. The method also includes selectively controlling a current distribution along a length of the first and second elongated conductive radiating elements to form at any wavelength selected within the pattern wavelength range, an antenna radiation pattern having a peak in a direction substantially orthogonal to an axis aligned with a length of the elongated conductive radiating elements.

The method also involves selectively controlling the current distribution along the length of the first and second conductive radiating elements to limit variations in gain orthogonal to the axis of the antenna. In some embodiments, these gain variations have been limited to a value less than about 6 dB. In other embodiments, the current distribution is controlled to limit variations in gain orthogonal to the axis to a value less than about 3 dB over the entire pattern wavelength range of the antenna. Optimal values of p and L can be selected using the numerical modeling techniques described herein for limiting such gain variations.

Notably, in each of the embodiments of the invention described herein, the current distribution in the radiating element has been described herein as being controlled using an inductor component conductively connected between a plurality of sub-elements which collectively define the elongated conductive radiating element. However, the invention is not limited in this regard and a combination of inductors and/or capacitors arranged in a network can also be used in place of the single inductor as described herein. Moreover, resistors can also be used in place of the inductors described herein, although such arrangements will have a lower overall efficiency as compared to inductor based designs.

Those skilled in the art will appreciate that once the antenna design has been optimized to provide a suitable antenna radiation pattern over the entire pattern wavelength range, the method can continue with the step of impedance matching an input of the dipole antenna to a transmitter that is intended to provide the radio frequency signal over an entire range of the pattern wavelength range.

Further, in the case of a monopole antenna a similar methodology can be used to extend the pattern wavelength range of an antenna over a wide range of wavelengths. In such cases the method involves exciting with a radio frequency signal, a monopole antenna including an elongated conductive radiating element having an overall length l to produce an oscillating time varying electric current within the elongated conductive radiating element. The method further includes selectively varying the radio frequency signal to have any wavelength λ within a pattern wavelength range of the antenna extending from at least about 0.25l to at least about 1.0l. In other embodiments, the radio frequency signal can be varied to have any wavelength λ within a pattern wavelength range of the antenna extending from at least about ⅙l to about 2l. As with the dipole embodiment, this is accomplished by selectively controlling a current distribution along a length of the elongated conductive radiating element to form at any wavelength selected within the pattern wavelength range, an antenna radiation pattern peak in a direction substantially orthogonal to an axis aligned with a length of the elongated conductive radiating element.

As with the dipole arrangement, the current distribution along the length of the monopole conductive radiating element can be controlled so as to limit variations in gain orthogonal to the antenna length to a value less than about 6 dB. However, in other embodiments, current distribution along the length of the conductive radiating element can be controlled to limit variations in gain orthogonal to the axis to a value less than about 3 dB.

The inventive arrangements and methods described herein are not limited to dipole antennas. Instead, these techniques can also be used in disc cone antennas and a variety of other basic antenna designs to increase the upper frequency boundary of the pattern wavelength range. In the disc-cone case, an inductor would be placed along the length of each of the disc-cone antenna elements using techniques similar to those described above relative to the dipole embodiment. Further, it should be appreciated that the dipole and monopole antenna elements described herein can be combined with other antenna elements. For example, a dipole element as described herein can be used as a driven element and may be combined with parasitic elements such as reflector elements and/or director elements. In other embodiments, the antennas described herein can be used without limitation to form antenna arrays or other more complex antenna designs.

Applicants present certain theoretical aspects above that are believed to be accurate and that appear to explain observations made regarding embodiments of the invention. However, embodiments of the invention may be practiced without the theoretical aspects presented. Moreover, the theoretical aspects are presented with the understanding that Applicants do not seek to be bound by the theory presented.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

Also, while various embodiments of the present invention have been described above, it should be understood that they have been presented by way of example only, and not limitation. Numerous changes to the disclosed embodiments can be made in accordance with the disclosure herein without departing from the spirit or scope of the invention. For example, the various embodiments of the invention are not limited with regard to any particular type of antenna described herein. Thus, the breadth and scope of the present invention should not be limited by any of the above described embodiments. Rather, the scope of the invention should be defined in accordance with the following claims and their equivalents.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

We claim:

1. A method for producing with a dipole antenna electromagnetic radiation in a desired direction over a wide range of wavelengths, comprising:

exciting with a radio frequency signal first and second elongated conductive radiating elements of a dipole antenna having a combined overall length l to produce an oscillating time varying electric current within the first and second elongated conductive radiating elements;

selectively varying said radio frequency signal to have any wavelength λ within a pattern wavelength range of said antenna extending from about 0.5l to at least about 2.0l; and selectively controlling a current distribution along a length of said first and second elongated conductive radiating elements to form, at any wavelength selected within said pattern wavelength range, an antenna radiation pattern having a peak in a direction substantially orthogonal to a length of said elongated conductive radiating elements.

2. The method according to claim 1, further comprising selectively controlling said current distribution along said length of said first and second conductive radiating elements to limit variations in gain orthogonal to said axis to a value less than about 6 dB throughout said pattern wavelength range.

3. The method according to claim 1, further comprising selectively controlling said current distribution along said length of said first and second conductive radiating elements to limit variations in gain orthogonal to said axis to a value less than about 3 dB throughout said pattern wavelength range.

4. The method according to claim 1, wherein said current distribution in said first elongated conductive element is controlled using a first inductor component conductively connected between a plurality of sub-elements which collectively define said first elongated conductive radiating element.

5. The method according to claim 4, wherein said current distribution in said second elongated conductive element is controlled using a second inductor component conductively connected between a plurality of sub-elements which collectively define said second elongated conductive radiating element.

6. The method according to claim 5, wherein a length of each sub-element and an inductance value of said first and second inductor are selected based on numerical antenna modeling in which said length of each sub-element and said inductance value are iteratively varied to determine optimum values for maintaining said antenna radiation pattern peak in said orthogonal direction throughout said pattern wavelength range.

7. The method according to claim 6, wherein said length of each sub-element and said inductance value are iteratively varied to determine optimum values for minimizing gain variation in a direction orthogonal to said axis throughout said pattern wavelength range.

8. The method according to claim 1, wherein said step of selectively varying said radio frequency signal further comprises varying said radio frequency signal to have any wavelength within a pattern wavelength range of said antenna extending from at least about ⅓l to at least about 8l.

9. The method according to claim 1, further comprising impedance matching an input of said dipole antenna to a transmitter providing said radio frequency signal over an entire range of said pattern wavelength range.

10. A method for producing with a monopole antenna excited against a counterpoise electromagnetic radiation in a desired direction over a wide range of wavelengths, comprising:

exciting with a radio frequency signal a monopole antenna including an elongated conductive radiating element having an overall length l to produce an oscillating time varying electric current within the elongated conductive radiating element;

selectively varying said radio frequency signal to have any wavelength λ within a pattern wavelength range of said antenna extending from about 0.25l to at least about 1.0l; and selectively controlling a current distribution along a length of said elongated conductive radiating element to form, at any wavelength selected within said pattern wavelength range, an antenna radiation pattern peak in a direction substantially orthogonal to a length of said elongated conductive radiating element.

11. The method according to claim 10, further comprising selectively controlling said current distribution along said length of said conductive radiating element to limit variations in gain orthogonal to said axis to a value less than about 6 dB throughout said pattern wavelength range.

12. The method according to claim 10, further comprising selectively controlling said current distribution along said length of said conductive radiating element to limit variations in gain orthogonal to said axis to a value less than about 3 dB throughout said pattern wavelength range.

13. The method according to claim 10, wherein said current distribution in said elongated conductive element is controlled using an inductor component conductively connected between a plurality of sub-elements which collectively define said elongated conductive radiating element.

14. The method according to claim 13, wherein a length of each sub-element and an inductance value of said inductor are selected based on numerical antenna modeling in which said length of each sub-element and said inductance value are iteratively varied to determine optimum values for maintaining said antenna radiation pattern peak in said orthogonal direction throughout said pattern wavelength range.

15. The method according to claim 10, wherein said step of selectively varying said radio frequency signal further comprises varying said radio frequency signal to have any wavelength within a pattern wavelength range of said antenna extending from about ⅙l to at least about 4l.

16. A radio system including a dipole antenna excited by a transmitter and configured for producing electromagnetic radiation in a desired direction over a wide range of wavelengths, comprising:

a dipole antenna formed from first and second elongated conductive radiating elements extending from a central feed point and having total length l, each said elongated conductive radiating element formed from a plurality of elongated sub-elements conductively connected by an inductor positioned at a location along a length of said conductive radiating element; and a transmitter coupled to an input port at said central feed of said dipole antenna configured for exciting said dipole antenna with an exciter signal at any wavelength λ in a pattern wavelength range of said dipole antenna extending from about 0.5l to at least about 2.0l;

wherein said dipole antenna is responsive to said exciter signal for producing an antenna radiation pattern peak in a direction substantially orthogonal to a length of said elongated conductive radiating element over all of said pattern wavelength range.

17. The radio system according to claim 16 wherein said pattern wavelength range extends from about ⅓l to at least about 8l.

18. A radio system including a monopole antenna excited against a counterpoise by a transmitter and configured for producing electromagnetic radiation in a desired direction over a wide range of wavelengths, comprising:

a monopole antenna formed from an elongated conductive radiating element having length l and formed from two elongated sub-elements conductively connected together by an inductor positioned at a location along a length of said conductive radiating element; and a transmitter coupled to an input port of said monopole antenna configured for exciting said antenna with an exciter signal at any wavelength λ in a pattern wavelength range of said monopole antenna extending from about 0.25l to at least about 1.0l;

wherein said monopole antenna is responsive to said exciter signal for producing an antenna radiation pattern peak in a direction substantially orthogonal to a length of said elongated conductive radiating element over all of said pattern wavelength range.

19. The radio system according to claim 18 wherein said pattern wavelength range extends from about ⅙l to at least about 4l.

20. A dipole antenna for producing electromagnetic radiation in a desired direction over a wide range of wavelengths, comprising:

a dipole antenna formed from first and second elongated conductive radiating elements extending from a central feed point and having total length l, each said elongated conductive radiating element formed from a plurality of elongated sub-elements conductively connected together by an inductor positioned at a location along a length of said conductive radiating element; and wherein a position of said inductor along said length and a value of said inductor are configured such that said dipole antenna is responsive to an exciter signal at any wavelength λ applied to said central feed point within a pattern wavelength range, where λ extends from about 0.5l to at least about 2.0l, for producing an antenna radiation pattern peak in a direction substantially orthogonal to an axis aligned with a length of said elongated conductive radiating element over all of said pattern wavelength range.

21. The dipole antenna of claim 20 wherein said pattern wavelength range extends from about ⅓l to at least about 8l.

22. A monopole antenna for producing electromagnetic radiation in a desired direction over a wide range of wavelengths, comprising:

a monopole antenna formed from an elongated conductive radiating element having length l and formed from two elongated sub-elements conductively connected together by an inductor positioned at a location along a length of said conductive radiating element;

a transmitter coupled to an input port of said monopole antenna configured for exciting said antenna with an exciter signal in a pattern wavelength range of said monopole antenna extending from about 0.25l to at least about 1.0l;

wherein said monopole antenna is responsive to an exciter signal at any wavelength λ applied to a feed point proximate to one end of said elongated conductive element within a pattern wavelength range, where λ extends from about 0.25l to at least about 1.0l, for producing an antenna radiation pattern peak in a direction substantially orthogonal to an axis aligned with a length of said elongated conductive radiating element over all of said pattern wavelength range.

23. The radio system according to claim 22 wherein said pattern wavelength range extends from about ⅙l to at least about 4l.

* * * * *